United States Patent [19]

Metzger

[11] 4,079,162

[45] Mar. 14, 1978

[54] SOUNDPROOF STRUCTURE

[75] Inventor: Arthur C. Metzger, Wayland, Mass.

[73] Assignee: Aim Associates, Inc., Tewksbury, Mass.

[21] Appl. No.: 675,511

[22] Filed: Apr. 9, 1976

Related U.S. Application Data

[63] Continuation of Ser. No. 452,848, March 20, 1974, abandoned.

[51] Int. Cl.[2] ..... E04B 1/99; G10K 11/04; C04B 43/00

[52] U.S. Cl. ..... 428/312; 181/286; 252/62; 260/2.5 BE; 260/37 EP; 428/325; 428/357; 428/406; 428/417; 428/913

[58] Field of Search ..... 428/325, 331, 357, 406, 428/417, 418, 158, 241, 306, 308, 312, 416, 450, 913; 252/62; 181/33 G, 33 GA; 260/37 EP, 2.5 B, 2.5 BE

[56] References Cited

U.S. PATENT DOCUMENTS

| | | | |
|---|---|---|---|
| 2,806,509 | 9/1957 | Bozzacco et al. | 428/241 |
| 2,937,668 | 5/1960 | Carey et al. | 428/325 X |
| 3,316,139 | 4/1967 | Alford et al. | 428/227 |
| 3,325,303 | 6/1967 | Lant et al. | 428/325 |
| 3,616,174 | 10/1971 | Atkins | 428/325 |
| 3,632,703 | 1/1972 | Sullivan et al. | 264/120 X |
| 3,661,673 | 5/1972 | Merriam | 156/279 |
| 3,726,755 | 4/1973 | Shannon | 428/406 X |
| 3,769,770 | 11/1973 | Deschamps et al. | 52/404 |
| 3,788,937 | 1/1974 | Lee | 428/241 X |
| 3,917,547 | 11/1975 | Massey | 428/406 X |

*Primary Examiner*—Harold Ansher
*Attorney, Agent, or Firm*—James J. Cannon, Jr.

[57] ABSTRACT

A structure that is preferably constructed in sheet form and that provides improved sound attenuation with a relatively small thickness. The materials comprising the structure include a myriad of hollow glass microspheres interspersed, preferably by a blending process, into a curable resin base. Improved acoustic attenuation is provided by employing microspheres of the type containing a vacuum and selecting a resin base that has good flexure qualities and is relatively soft with a relatively low indentation hardness.

4 Claims, 3 Drawing Figures

SOUNDPROOF STRUCTURE

This application is a continuation of application Ser. No. 452,848, filed Mar. 20, 1974, now abandoned.

BACKGROUND AND SUMMARY OF THE INVENTION

The present invention relates in general to soundproof materials and structures preferably for use in the medical or construction field and wherever it is necessary to control sound emission or transmission. More particularly, the present invention is directed to an improved soundproof structure that can be made in a relatively thin sheet or various other forms and that is of a composite type consisting of hollow glass microspheres in a curable resin base.

Noise pollution has become an ever increasing problem within recent years. Because of the increasing interest by environmentalists as evidenced by the enactment of both state and federal laws, there is an increased requirement to protect from and/or restrain sound emission. There have been techniques available to achieve sound reduction or confinement, but these techniques have certain limitations or disadvantages associated therewith.

The usual process to obtain improved acoustic attenuation is to increase the thickness of a wall or partition. However, there are disadvantages associated with this practice such as the attendant cost increase, weight increase and massive thickness.

Accordingly, it is an object of the present invention to provide a soundproof material and structure preferably in the form of a panel that can provide good sound attenuation with a relatively thin panel thickness.

Another object of the present invention is to provide a soundproof structure that can be manufactured relatively cheaply and that is characterized by other characteristics such as good insulating and fire resistance qualities.

Regarding the theory relating to the discovery of the present invention, it is known that airborn sound is transmitted by the molecules of the air. It is transmitted through a rigid partition, for example, such as a wall, by forcing the wall into vibration. The vibrating wall or partition becomes a secondary source radiating sound to the side opposite the original source. For most conventional soundproof structures over a large portion of the audio frequency range approximately a 4–5 db loss occurs for each doubling of the weight.

Traditionally, therefore, it has been customary to depend on thickness, density and/or porosity to achieve varying levels of elastic wave attenuation in acoustic materials. It has been recognized in accordance with the present invention that at least two other factors are significant in providing further improvement of sound attenuation in panels and in other materials.

A soundwave tends to set in motion the molecules of a substance that it impinges upon and the material, as a result, moves as a direct function of the impinging wave. It is theorized in accordance with the present invention that the material will absorb varying amounts of energy depending upon its elasticity and the resonant characteristic of the material. It has been found that a material that has a very good low frequency (100–2,000 hertz), mechanical vibration/stock transmission absorbing quality is characterized by corresponding acoustic attenuation performance.

Accordingly, in the present invention the base material that comprises the soundproof structure is preferably a curable resin having a soft flexible characteristic, which correlates to an A or low D scale indentation (Shore) hardness. There are several epoxy resins, polyurethanes, and RTV silicones that have the desired shock/vibration isolation properties, flexure and Shore hardness.

Another factor in accordance with the theory of the present invention relates to the realization that audio frequency soundwaves are very much dependent on the existence of gas molecules for the transmission of sound through air. Thus, in accordance with the present invention the soundproof structure material also comprises a filler material in the form of a myriad of hollow microspheres preferably constructed of glass and which preferably contain at least a partial vacuum which has been found to provide additional improved acoustic attenuation.

Further aspects of the present invention relate to the process by which the structure of the present invention is fabricated. In accordance with this invention it has been further found that by providing at least twice the volume of microspheres to the volume of resin, improved attenuation follows. It is theorized that by providing as large a volume of microspheres as possible that firstly there is a larger vacuum volume and secondly a wave travelling through the material will experience an increased number of transitions between materials of different index of refraction (glass-resin-vacuum).

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
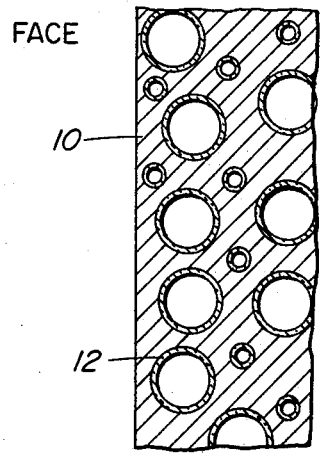
FIG. 1 is a cross-sectional view that is somewhat enlarged and taken through a sheet of material constructed in accordance with the present invention.
Figure 2:
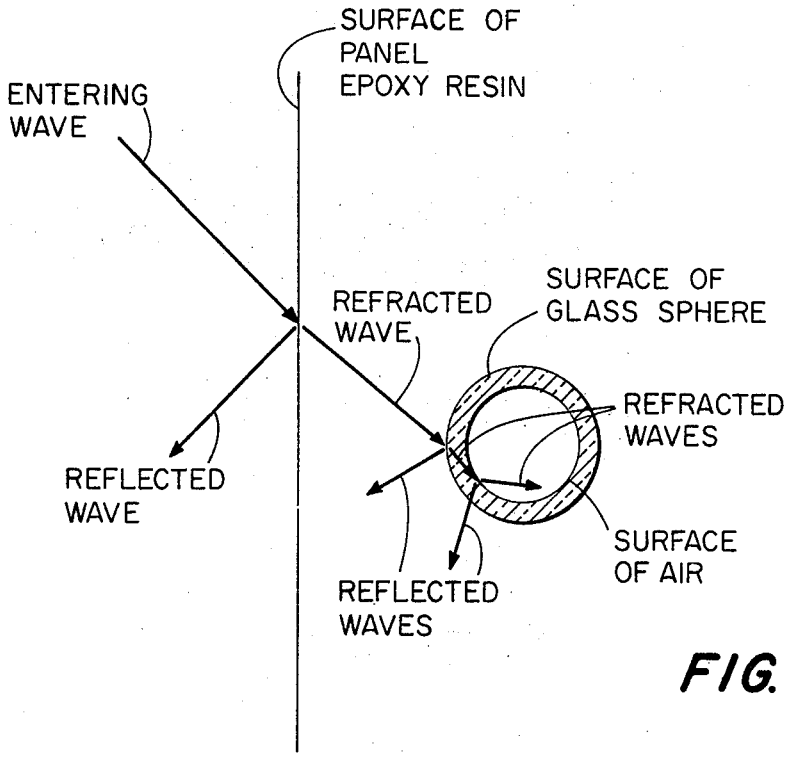
FIG. 2 is a further enlarged diagramatic view of the structure shown in FIG. 1.

FIG. 1 is a somewhat enlarged cross-sectional view through a portion of a panel constructed of the material of the present invention. The structure is composed from a curable resin base 10 having randomly interspersed throughout a myriad of hollow glass microspheres 12. FIG. 2 shows a still further sectional enlargement of the material of this invention also showing diagramatically the impingement of a soundwave.

Referring to both FIGS. 1 and 2 a soundwave that impinges on the front surface of the panel is partly reflected, part causes a compression of the resin base 10 being absorbed thereby, while part is refracted and passed on through the material.

As previously mentioned, one of the realizations of the present invention is providing a resin base or binder that is relatively soft, flexible and compressible. It is this compressibility and elastic property of the resin binder that determines the transmission loss of the material which in turn is a function of the frequency of the impinging soundwave.

As also previously mentioned, the sound, as it strikes the surface and starts its penetration of the material, will be refracted as indicated in FIG. 2. The amount of refraction is a function of the difference in densities of the materials forming a change in the refraction boundary. As indicated in FIG. 2 the difference in densities between the epoxy resin binder 10, the glass microspheres 12, and the entrapped reduced atmospheric pressure within the microspheres, causes a continuing process of refraction, reflection and absorption.

Some of the energy travels through the surface skin of the microspheres while some of the energy enters the vacuum inside the sphere as indicated in FIG. 2. The wave entering the sphere is subjected to further loss because of the reduced atmosphere within the sphere. Also, it is preferred that the skin-thickness of the microspheres be as thin as practicably possible. As indicated hereinafter the wall thickness is preferably on the order of two microns or less. By making the wall or skin-thickness of the sphere small there is a greater vacuum volume.

The wave energy is alternately entering the binder and spheres further creating refraction, reflection and absorption of the wave as it moves through the material. As previously indicated it is preferred that the majority of the volume be taken up by the spheres and that this volume be at least twice the volume of the binder material.

Accordingly, the spheres are disposed quite close to each other but preferably not touching each other. This arrangement is believed to be provided by thoroughly mixing or blending the microspheres and the not yet cured epoxy resin. This blending must be for sufficiently long time period so that the consistency is fairly uniform with the binder encapsulating by far the majority of the microspheres.

In accordance with this invention, a sheet of acoustical lead may also be inserted for its density properties, further providing transmission loss. This lead sheet may be placed preferably within the panel in any position between the two surfaces thereof. Also, a steel or other metal panel can be used even as one face of the completed panel. Furthermore, it is also possible to use powdered aluminum or other equally dense material interspersed or layered within the binder.

It has also been found in accordance with this invention that good transmission loss or attenuation can be provided at a relatively thin thickness of the panel. Although increased thickness of the product provides an increase in attenuation the maximum efficiency occurs at about a thickness of $\frac{3}{8}$ inch. The standard transmission loss associated with the material is over 60Db (see FIG. 3) for a density (per thickness) of 1.58 lbs./ft$^2$. This provides results that previously could only be provided with thicknesses of 6 inches or more with considerably higher densities. Materials with similar densities have an STL of 20–40Db only.

Figure 3:
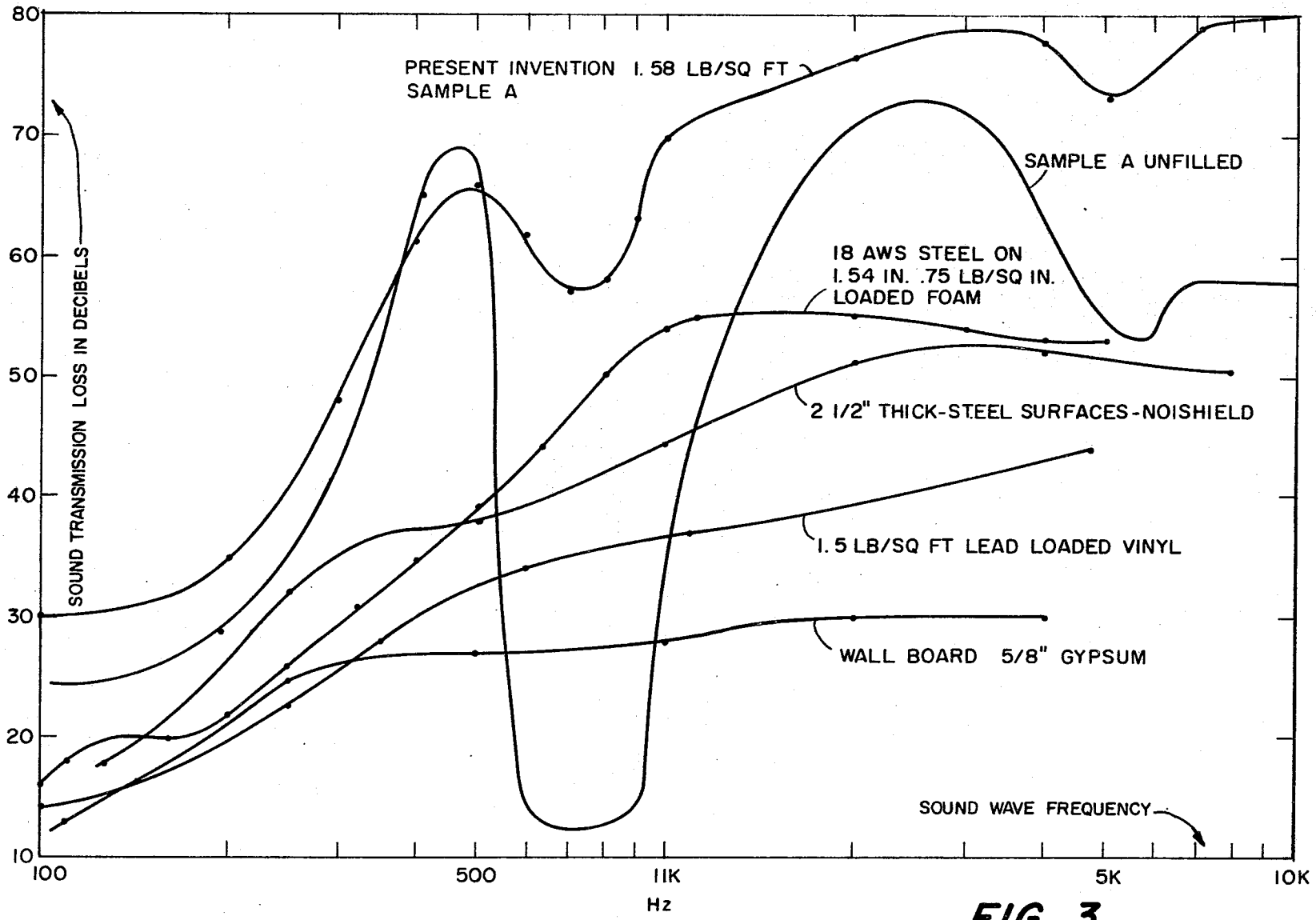
FIG. 3 is a graph of transmission loss versus frequency for different material including the material of the present invention.

FIG. 3 shows various transmission loss (Db) curves for different products as identified. A curve is also shown for the unfilled resin Sample A. It is noted that especially at the low frequency end, the loss is poor and yet with the addition of the glass microspheres the low frequency loss at only 100 cyles is 30Db.

Turning now to the specific materials that are employed in the structure of the present invention, reference is made to Tables I and II. Table I shows a number of sample materials for the base or binder that have been used. The sample A appears to provide the best results.

In Table I Sample A is a pourable epoxy adhesive and potting compound produced by Amicon Corporation, Polymer Products Division, and is sold under their trademark UNISET (905–57). Sample B is manufactured by General Electric and is identified as their material RTV 616. Sample C is an epoxy resin manufactured by John C. Dolph Co. of Monmouth Junction, New Jersey, and is indentified as their Dolph CC-1087. Sample D is an epoxy resin manufactured by John C. Dolph Co. of Monmouth Junction, New Jersey, and is identified as their Dolph CB-1054. Sample E is an epoxy resin manufactured by Emerson & Cumming, Inc., of Canton, Massachusetts, and is identified as their Eccogel 1265. Sample F is manufactured by Emerson & Cumming, Inc., of Canton, Massachusetts, as their Eccosil 2CN. Sample G is made by 3M Co., and is identified as their Scotchcast 221.

It is obviously desirable that the base material have as many desirable characteristics as possible. For example, it is desirable that the specific gravity be as small as possible so that the panels are lightweight. It is also desirable that the panels be fire resistant. In accordance with the present invention it has been found that the material should be selected so that in its cured unfilled state (without glass spheres) it is relatively soft and flexible with a Shore rating on the order of A25. Experimentation has shown that as long as there is a resonable degree of softness and flexibility, desirable results occur. A range of exceptable Shore hardness is from on the order of A25 to as high as D60. This range is of the binder in its cured state without spheres. When the spheres are used in the final product of course the product assumes a stiffer shape.

The Shore hardness shown in Table I may be determined by a standard method of test such as set forth by the American Society for Testing and Materials (ASIM). A durometer of specific design is used in making these tests and different indentors are used corresponding to the two different scales. Actually, the readings on the two scales can be cross-correlated. For example, a reading of 100 on the A scale corresponds to approximately 60 on the D scale.

Another significant factor is the viscosity of the material in its uncured state. It is desirable to have this viscosity as low as possible. It has been found that the viscosity should preferably be less than 10,000 centipoises. With this relatively low viscosity it is easier to add more filler material such as glass spheres which, as mentioned previously, is desirable.

Table II shows the two types of hollow glass microspheres that have been tried. Sample 1 is supplied by Emerson & Cummings, Inc., of Canton, Massachusetts under their identification 1G101. Sample 2 is sold by the 3M Co., under their identification No. B25B. Both of these samples have been selected as characterized by a one-third or less entrapped atmosphere. As previously indicated the preferred structure contains microspheres with less than atmospheric pressure inside. Also, it is desirable that the particle size be as small as possible preferably on the order of 250 microns or less and of random diameters to improve their dispersion.

As previously mentioned, other fillers may also be used such as relatively thin lead sheets. Other fillers that can be incorporated include powdered lead or aluminum and other fillers which have a high density.

In constructing a panel of the structure of the present invention one can select, for example, Sample A from Table I and Sample 1 from Table II. The two materials are mixed or blended together thoroughly so that the microspheres are randomly dispersed throughout the binder. In this way, the binder forms a thin film around each of the spheres as shown in FIG. 1. To increase the volume ratio of spheres to binder material, it is desirable to slightly elevate (90°-100° F) the temperature during mixing, thereby lowering the viscosity of the binder. Most successful results have been achieved with ratios of 2 to 3 parts of spheres for each part of the binder on a volume basis. With some of the lower viscosity binder material ratios of as high as 4 to 1 can be obtained.

TABLE NO. I

| | | BINDER/ADHESIVE PRODUCTS | | | | | | |
|---|---|---|---|---|---|---|---|---|
| PARAMETER | UNITS | A | B | C | D | E | F | G |
| Material | | Epoxy Adhesive 1 part | RTV Silicon 2 parts | Epoxy Resin 2 parts | Filled Epoxy Resin 2 parts | Epoxy Resin 2 parts | RTV Silicone 2 parts | Polyurethane Resin 2 parts |
| Toxicity | | none | none | none | none | none | none | none |
| Flexibility | | Tough Flex to Semi Flex | | Very Flex | Tough Flex | Tough Flex | | Very Flex |
| Specific Gravity | | 1.43 | 1.22 | 1.15 | 1.50 | 1.00 | 0.99 | 1.06 |
| Viscosity (Cured) | cps | 7400 | 90 | 1280 | 950 | 600 | 200 | 900 |
| Shore Hardness | | 42D | 45A | 40D | 55D | 25A | 22A | 57A |
| Temperature | | over 250° F | −65° F to +400° F | | | | | over 250° F |
| Fire Resistant | Per UL94 | SE-O | Retard | No | Yes | No | | Self Ext. |
| Thermal Conductivity | BTU/hr $FT^2$ ° F in | 2.0 | 0.16 | $4\times10^{-4}$ Cal/sec | $1.25\times10^{3}$ Cal/sec | 1.8 | | $4.2\times10^{-4}$ |
| Thermal Expansion | in/in ° F | $6\times10^{-5}$ | $15\times10^{-5}$ | | $6.7\times10^{-5}$ | $3.3\times10^{-5}$ | | $21.1\times10^{-5}$ |
| Water Absorption | % | 0.7 10 days | | 0.14 | 0.30 | | | .65 |
| Standard Transmission Loss (STL) | Db ⅜" | 61 | 48 | 65 | | | | 64 |
| Cure | R.T. | 3 days 1½ hrs | | 1 day 4 hrs | 6 wks 3-5 hrs | 3 days 4 hrs | 1 day | 3 days 3 hrs |
| | Elevated | 350F | | | 275 F | 200 F | 150 F | 366 F |

TABLE II

| | | GLASS SPHERES | |
|---|---|---|---|
| PARAMETER | UNITS | SAMPLE NO. 1 | SAMPLE NO. 2 |
| Material | | Sodium Borosilicate | |
| Bulk Density | $lb/Ft^3$ | 14 | 9.3 |
| True Density | $lb/Ft^3$ | 20 | 14 |
| Particle Size | Microns | 10 to 250 | 20 to 120 |
| Wall Thickness | Microns | 2.0 | 0.5 to 2.0 |
| Temperature | ° F Softening | 900 | 1140 |
| Moisture Absorption | % of Total Weight | 1 to 5 hrs. 0.68 24 hrs 1.40 | |
| Thermal Conductivity | BTU/hr $Ft^2$ | 0.4 | 0.2 to 0.8 |
| Strength Compressive | Volume % Survivors at pressure | 500 psi-97.2 1000 psi-88.2 1500 psi-76.6 | 220-250 psi 90% |

The hollow glass spheres appear as fine white sand, hole free and they are very resistant to water, alkali, acid and hydrocarbons.

Once the binder and filler material of microspheres has been thoroughly mixed the material flows through a die into a large pan which may be a 4 × 8 inch pan which can be moved continuously in front of the die. The die and pan are contained in an oven conveyor system that may have temperatures on the order of 350° F. From the setting oven, after a predetermined heating process, the material then passes to a curing oven where the panels can be stacked to complete their curing process. The use of higher temperatures can reduce the set/cure time and further simplify the oven process. To remove mixing bubbles a vacuum may be used on the feed tank.

The material can be free flowed into a flat mold or alternatively formed into other configurations such as motor enclosures, headphones, protective caps, fillers for doors, fillers for paneling in various types of vehicles, pipe enclosures and sound rooms. In panels the surface can be coarsened to provide further improvement in attenuation. The material can be used also in other forms such as in a putty or in spray forms. The material can be used with many different finishes such as paper, photo, metal, wood or plastic.

Having described the structure of the present invention it should now be obvious to one skilled in the art that there are many different combinations that are contemplated as being covered by the present invention. For example, only two types of microspheres have been shown. However, there are probably other types of microspheres possibly not constructed of glass but containing a reduced atmospheric pressure that could be employed in the structure of the present invention. Also, there are various types of resin materials that may be used within the limits as set forth by the present invention.

What is claimed is:

1. A wall panel having improved sound attenuating characteristics consisting essentially of:

a base material of a curable resin having an uncured viscosity at ambient temperature of less than 10,000 centipoise and having a Shore hardness in the cured state ranging from 25 on the A scale to 100 on the A scale;

said curable resin having a specific gravity between 0.99 and 1.50;

said curable resin being relatively soft and flexible in its cured state;

a substantial plurality of hollow microspheres randomly interspersed in said base material, each of said hollow microspheres having an interior pressure of one-third atmosphere or less;

the volume of said hollow microspheres being at least equal to the volume of said base material;

said microspheres having diameters ranging from 10 to 250 microns and having a skin thickness of 2 microns or less;

said base material and said microspheres being mixed and blended thoroughly prior to curing, such that said base material encapsulates all of said microspheres in a homogenious mixture and such that said microspheres remain uncrushed;

2. A method of making a sound attentuating structure consisting essentially of the steps of:

providing a curable resin base material having an uncured viscosity at ambient temperature of less than 10,000 centipoise and having a Shore hardness in the cured state, ranging from 25 on the A scale to 100 on the A scale;

said curable resin having a specific gravity between .99 and 1.50;

providing a substantial plurality of hollow microspheres of random size ranging in diameter from 10 to 250 microns and having a skin thickness of 2 microns or less, and said microspheres having a interior pressure of less than one-third atmosphere;

the volume of said microspheres being at least equal to the volume of said base material;

thoroughly blending said microspheres within said base material prior to curing to encapsulate substantially all of said microspheres with said base material without crushing said microspheres and to disburse said microspheres randomly in said base material in a homogeneous mixture;

curing said mixture of base material and microspheres;

said curing mixture being relatively soft and flexible in its cured state.

3. An intermediate material having improved sound attenuating characteristics consisting of:

a curable, low viscosity adhesive binder base material having a viscosity in the uncured state at ambient temperature of less than 10,000 centipoise and having a Shore hardness in the cured state ranging from 25 on the A scale to 100 on the A scale;

said base material having a specific gravity ranging from 0.99 to 1.50;

a substantial plurality of hollow, sodium borosilicate microspheres, at least equal in volume to said binder base material, being randomly sized, randomly interspersed in and individually encapsulated by said binder base;

said hollow microspheres having an interior pressure of less than one-third atmosphere;

said hollow microspheres having a skin thickness of less than 2 microns and ranging from 10 to 250 microns in diameter;

said microspheres being mixed with said binder base such that said microspheres will remain uncrushed, preferably under a vacuum to exclude substantially all free air and air bubbles from said compound.

4. The intermediate material of claim 3 wherein said adhesive binder base material may be selected from the group consisting of epoxy resins, polyurethanes and silicones.

* * * * *